US011179741B1

(12) United States Patent
Liu

(10) Patent No.: US 11,179,741 B1
(45) Date of Patent: Nov. 23, 2021

(54) AUTOMATIC LIQUID DISPENSING BOTTLE CAP WITH INFRARED INDUCTION AND INTELLIGENT RECOGNITION

(71) Applicant: Hongwei Liu, Shenzhen (CN)

(72) Inventor: Hongwei Liu, Shenzhen (CN)

( * ) Notice: Subject to any disclaimer, the term of this patent is extended or adjusted under 35 U.S.C. 154(b) by 0 days.

(21) Appl. No.: 17/094,765

(22) Filed: Nov. 10, 2020

(51) Int. Cl.
*B05B 12/12* (2006.01)
*B05B 5/053* (2006.01)

(52) U.S. Cl.
CPC ..... *B05B 12/122* (2013.01); *B05B 5/053* (2013.01)

(58) Field of Classification Search
CPC ..... B05B 12/122; B05B 5/053; B65D 47/16; B65D 51/1633; B65D 83/262
USPC ..... 222/52, 63, 333, 504, 626
See application file for complete search history.

(56) References Cited

U.S. PATENT DOCUMENTS 4,261,485 A * 4/1981 Borg ..... B65D 47/24 137/38
5,379,916 A * 1/1995 Martindale ..... B67D 1/1234 222/1
5,505,349 A * 4/1996 Peckels ..... B67D 3/0041 222/36
7,900,799 B2 * 3/2011 Kuzar ..... B67D 3/0006 222/52
9,533,870 B2 * 1/2017 Zapp ..... B67D 3/041
9,821,997 B2 * 11/2017 Zapp ..... B67D 3/0041
2011/0016968 A1 * 1/2011 Eichholz ..... G01F 11/32 73/203
2011/0309103 A1 * 12/2011 Heatherly ..... B67D 3/00 222/52

* cited by examiner

*Primary Examiner* — Vishal Pancholi
(74) *Attorney, Agent, or Firm* — W&K IP

(57) ABSTRACT

An automatic liquid dispensing bottle cap with infrared induction and intelligent recognition, which relates to the technical field of daily necessities. It includes a bottle cap body, a lower motor shell, a motor and other components. The beneficial effects of this utility model are as follows: Through the setting of the infrared sensor, it can be widely used for liquid products such as shower gel, shampoo and hand sanitizer provided in medical institutions or public places. Compared with the traditional manual pressing head, the bottle cap can be removed and installed on liquid bottles of different sizes for use, or a general bottle body can be made for use with it. Its overall practicability is strong, and it has a great market promotion value.

7 Claims, 6 Drawing Sheets

AUTOMATIC LIQUID DISPENSING BOTTLE CAP WITH INFRARED INDUCTION AND INTELLIGENT RECOGNITION

TECHNICAL FIELD

This utility model relates to the technical field of daily necessities, in particular to an automatic liquid dispensing bottle cap with infrared induction and intelligent recognition.

BACKGROUND ART

Automatic liquid dispensers are more and more widely used in people's lives due to its convenience and sanitation. An automatic liquid dispenser includes a casing, electronic circuit board, infrared module, battery, etc. The infrared sensor senses the existence of a human hand in the detection area and transmits the signal to the electronic circuit board. The electronic circuit board drives the motor to work and squeeze out the liquid.

Traditional hand sanitizers, shower gels, shampoos, disinfectants, gels, detergents, etc. are bottled and capped. When using them, you need to press with one hand and receive the liquid with the other, so the operation is inconvenient and the user experience is not good, especially in public places, where the flow of people is large, and it is easy to cause cross-infection. At the same time, the existing automatic dispensers often need special liquid storage tanks with air inlets, and the original packaging containers of functional liquids such as hand sanitizers, shampoos and vegetable oil cannot be used, thus limiting the scope of use of the automatic dispensers and causing inconvenience to users.

SUMMARY OF THE UTILITY MODEL

The purpose of this utility model is to provide an automatic liquid dispensing bottle cap with infrared induction and intelligent recognition in view of the defects and deficiencies of the prior art, so as to solve the problems raised in the said background art. Through the setting of the infrared sensor, this utility model can be widely used for liquid products such as shower gel, shampoo and hand sanitizer provided in medical institutions or public places. Compared with the traditional manual pressing head, it can effectively quantify the amount of liquid for consistent dispensing, and avoid excessive or insufficient liquid dispensing by manual pressing each time, and the bottle cap of this utility model can be removed and installed on liquid bottles of different sizes for use, or a general bottle body can be made for use with it. It is easy to operate, clean and hygienic, and does not require contact, with excellent use effect, effectively avoiding cross-infection and the spread of bacteria; meanwhile, its structural design is environmentally friendly, without the need to produce a certain number of bottles, and it can be reused after liquid is injected into the bottle.

To achieve the said purpose, this utility model adopts the following technical solution: It includes a bottle cap body 1, a lower motor shell 2, a motor 3, an electronic circuit board 4, an upper motor shell 5, a cylindrical lithium battery 6, a motor battery cover 7, the lower end of the said bottle cap body 1 is provided with the lower motor shell 2, the upper end of the said lower motor shell 2 is provided with the upper motor shell 5, the said lower motor shell 2 is provided with the electronic circuit board 4, the motor 3 is arranged between the said lower motor shell 2 and the upper motor shell 5, and the lower motor shell 2 and the upper motor shell 5 are fixedly connected by a clip, the said upper motor shell 5 is provided with a control box 51, the said control box 51 has a rectangular structure, one end of the said control box 51 is provided with a counterbore groove 52, the said counterbore groove 52 is provided with a first battery compartment door lock 53 and a second battery compartment door fixing hole 54, the said first battery compartment door lock 53 and the second battery compartment door fixing hole 54 abut each other, the left and right sides of the said control box 51 and the first battery compartment door lock 53 are provided with fixing holes 55, there are a total of four fixing holes 55, the position where the outer periphery of the said control box 51 abuts against the upper motor shell 5 is provided with a battery compartment sealing rubber ring 8, the outer periphery of the said battery compartment sealing rubber ring 8 is provided with fixing posts 81, there are a total of four fixing posts 81, the said fixing posts 81 are provided in the fixing holes 55, the said control box 51 is provided with a cylindrical lithium battery 6, the upper end of the said cylindrical lithium battery 6 is provided with a battery compartment door 61, the said battery compartment door 61 is fixedly connected to the control box 51 through a clip, the upper end of the said battery compartment door 61 is provided with a motor battery cover 7, the said motor battery cover 7 is fixedly connected to the upper motor shell 5 through a clip, the said electronic circuit board 4 is provided with an infrared sensor 41 and a liquid outlet through hole 42, the upper end of the said electronic circuit board 4 is provided with an infrared transparent mirror 43, the said infrared transparent mirror 43 is provided with an infrared lamp cap 431, a button cap 432, a sealing ring 433 and a liquid outlet 434, the said infrared lamp cap 431 and the button cap 432 are arranged inside the infrared transparent mirror 43, the said sealing ring 433 is arranged on the outer periphery of the infrared transparent mirror 43, a liquid outlet 434 is provided on one end face of the said infrared transparent mirror 43, the said liquid outlet 434 is arranged in the liquid outlet through hole 42, and the said infrared transparent mirror 43 is arranged between the upper motor shell 5 and the electronic circuit board 4 through a sealing pad 44.

The said bottle cap body 1 is cylindrical, the front end of the bottle cap body 1 is provided with a liquid dispensing part 56, and the said liquid dispensing part 56 is in the shape of a pointed cone extending integrally, and the front end of the said liquid dispensing part 56 is provided with an indicator light mirror 561.

A foam generator 9 is provided on the side of the said motor 3, one end of the said foam generator 9 is provided with a foam generator upper cover 91, and the other end is provided with a foam generator lower cover 92, the said foam generator upper cover 91 is provided with a first liquid passage 911, the said foam generator lower cover 92 is provided with a second liquid passage 921, the said second liquid passage 921 is connected to the liquid outlet 434, the said first liquid passage 911 is connected with a liquid suction tube 93, and the liquid suction end of the said liquid suction tube 93 passes through the lower motor shell 2 and is connected to the liquid in the liquid bottle body.

A replaceable bottle cap 21 is provided at the lower end of the said lower motor shell 2, the lower part of the said lower motor shell 2 and the inner part of the replaceable bottle cap 21 are provided with engaging threads, the said lower motor shell 2 and the replaceable bottle cap 21 are rotatably fixed by the engaging threads, the outer circumference of the said replaceable bottle cap 21 is provided with a first anti-skid pattern 211 distributed at equal intervals, the said replaceable bottle cap 21 is provided with a cap lock 22 and a concealed air inlet 23, and an outlet protection pad 24 is provided between the bottle cap lock 22 and the liquid bottle body.

The said motor 3, the electronic circuit board 4 and the control box 51 are electrically connected.

There are two cylindrical lithium batteries 6, with the size of AAA.

The said motor battery cover 7 is provided with a second anti-skid pattern 71. The second anti-skid pattern 71 can increase the friction between the fingertip and the motor battery cover 7, so as to facilitate the removal of the motor battery cover 7.

The said replaceable bottle cap 21 can be removed and installed on liquid bottles of different sizes at any time.

The working principle of this utility model is as follows: Through the replaceable bottle cap, install the bottle cap body on an existing bottle body or special bottle body or general bottle body, or use it to replace the existing bottle cap directly, and fix it with the bottle cap lock during installation. The outlet protection pad is used for waterproof and leak-proof protection, and the liquid suction end of the liquid suction tube in the bottle cap body extends into the liquid bottle (containing hand sanitizer, shower gel, shampoo, cleanser, gel, etc.). During actual use, stretch your hand to the area below the liquid outlet, then the infrared sensor on the side of the liquid outlet can recognize and sense your hand, and the electronic circuit board transmits the signal to the motor to make it operate. At this time, the liquid suction end of the liquid suction tube starts to suck liquid from the liquid bottle, then the sucked liquid flows through the foam generator to generate liquid foam, and the liquid foam flows through the first liquid passage of the foam generator to the liquid outlet and gets to the user's hand to complete the automatic liquid dispensing process. When the liquid in the liquid bottle is used up, you can directly purchase the same kind of bagged liquid and pour it in the liquid bottle, and there is no need to replace the bottle body, which greatly reduces the user's use cost.

After adopting the above technical solution, the beneficial effects of this utility model are as follows: Through the setting of the infrared sensor, it can be widely used for liquid products such as shower gel, shampoo and hand sanitizer provided in medical institutions or public places. Compared with the traditional manual pressing head, it can effectively quantify the amount of liquid for consistent dispensing, and avoid excessive or insufficient liquid dispensing by manual pressing each time, and the bottle cap of this utility model can be removed and installed on liquid bottles of different sizes for use, or a general bottle body can be made for use with it. It is easy to operate, clean and hygienic, and does not require contact, with excellent use effect, effectively avoiding cross-infection and the spread of bacteria; meanwhile, its structural design is environmentally friendly, without the need to produce a certain number of bottles, and it can be reused after liquid is injected into the bottle. Its overall practicability is strong, and it has a great market promotion value.

DESCRIPTION OF THE DRAWINGS

To more clearly illustrate the technical solutions in the embodiments of this utility model or the prior art, the following will briefly introduce the drawings that will be used in the description of the embodiments or the prior art. Obviously, the drawings in the following description are just some embodiments of this utility model. For those of ordinary skill in the art, other drawings can be obtained based on these drawings without creative work.

Figure 1:
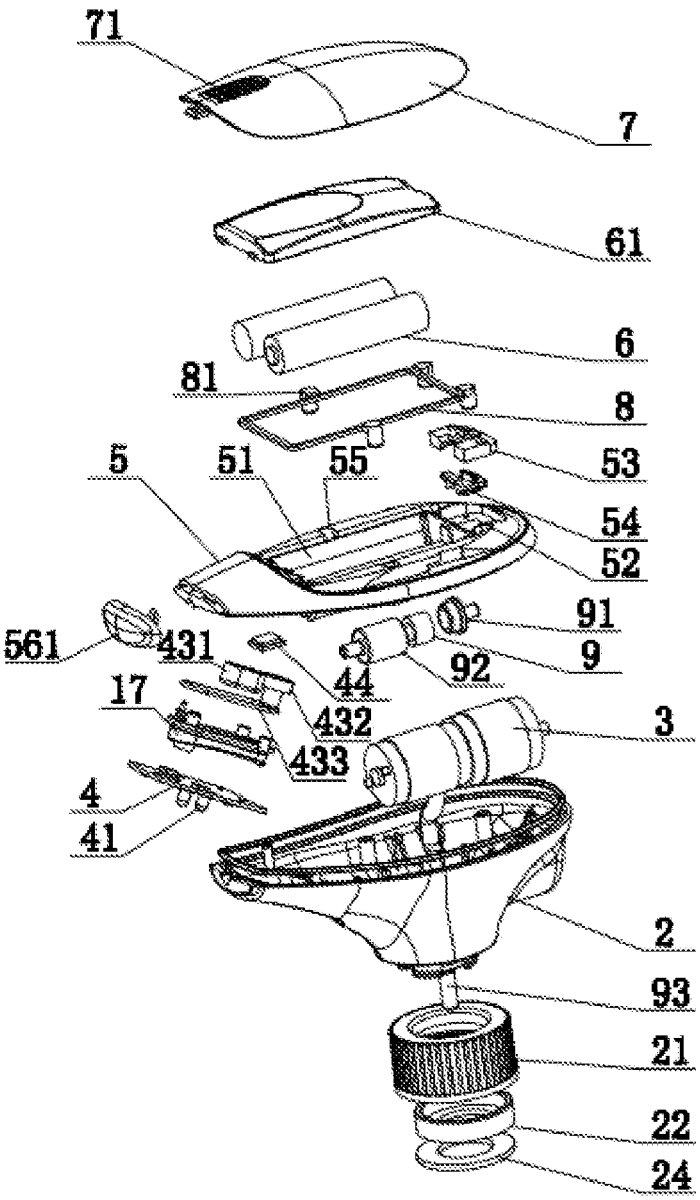
FIG. 1 is an exploded schematic view of the structure of this utility model.

Description of the numbers in the drawings: bottle cap body 1, lower motor shell 2, replaceable bottle cap 21, first anti-skid pattern 211, bottle cap lock 22, concealed air inlet 23, motor 3, electronic circuit board 4, infrared sensor 41, liquid outlet through hole 42, infrared transparent mirror 43, infrared lamp cap 431, button cap 432, sealing ring 433, liquid outlet 434, sealing pad 44, upper motor shell 5, control box 51, counterbore groove 52, first battery compartment door lock 53, second battery compartment door fixing hole 54, fixing hole 55, liquid dispensing part 56, indicator light mirror 561, cylindrical lithium battery 6, battery compartment door 61, motor battery cover 7, second anti-skid pattern 71, battery compartment sealing rubber ring 8, fixing post 81, foam generator 9, foam generator upper cover 91, first liquid passage 911, foam generator lower cover 92, second liquid passage 921, liquid suction tube 93.

DESCRIPTION OF PREFERRED EMBODIMENTS

Figure 2:
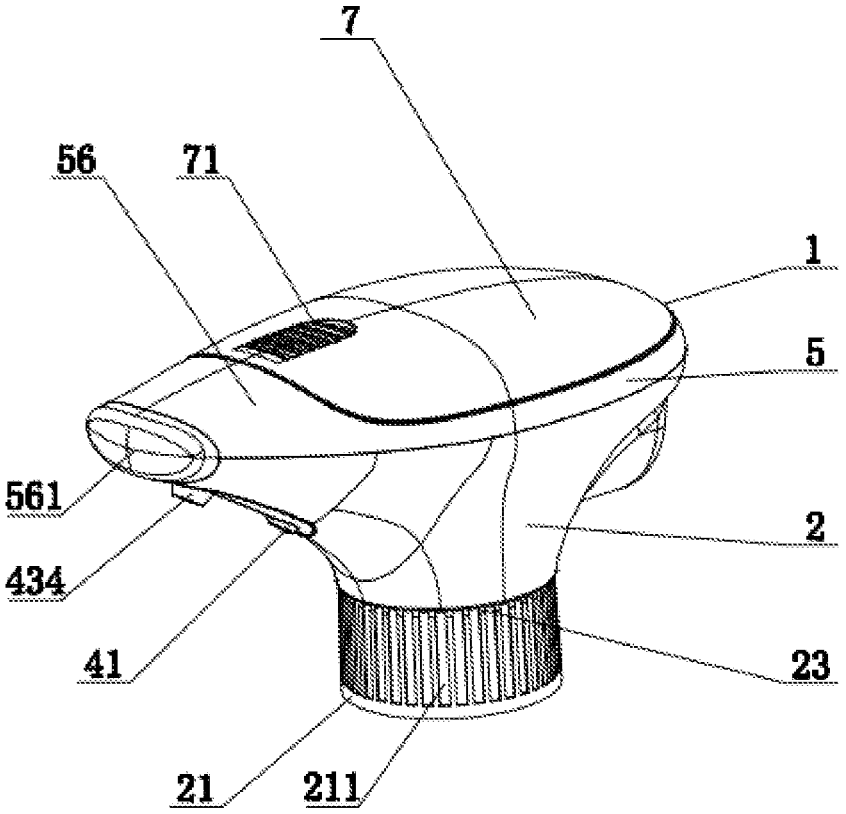
FIG. 2 is a schematic structural view of this utility model.
Figure 3:
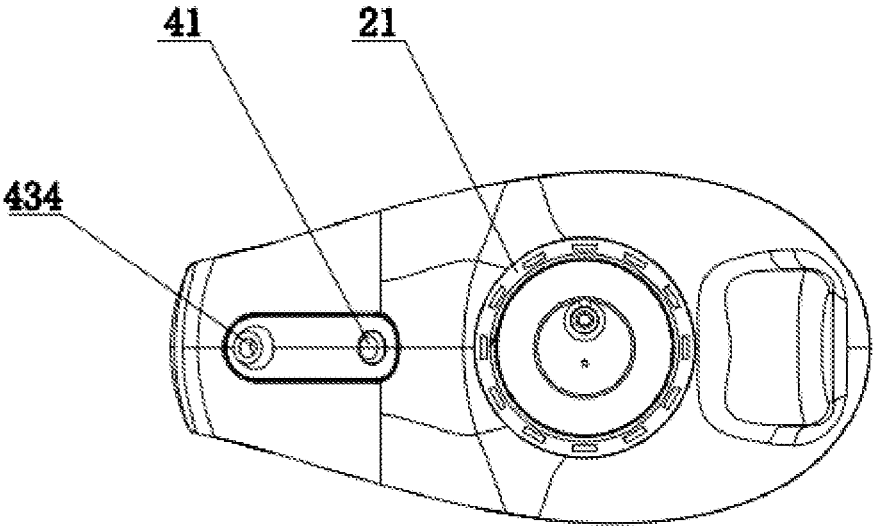
FIG. 3 is a schematic bottom view corresponding to FIG. 2.
Figure 4:
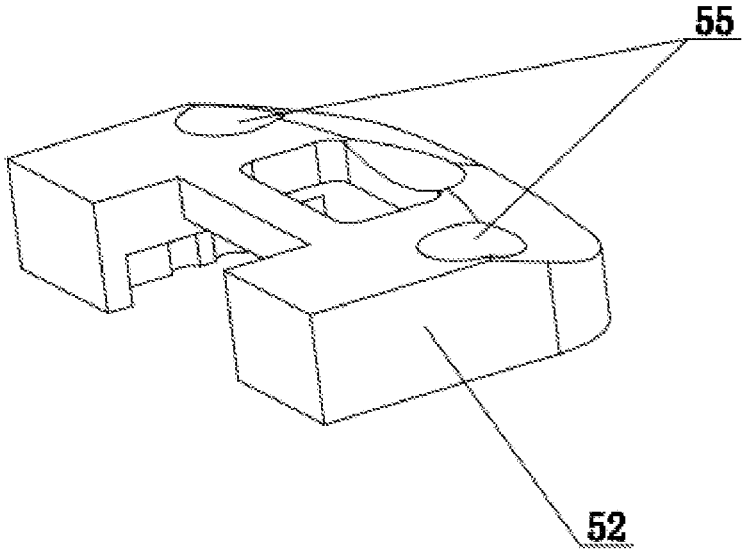
FIG. 4 is a schematic structural view of the first battery compartment door lock of this utility model.
Figure 5:
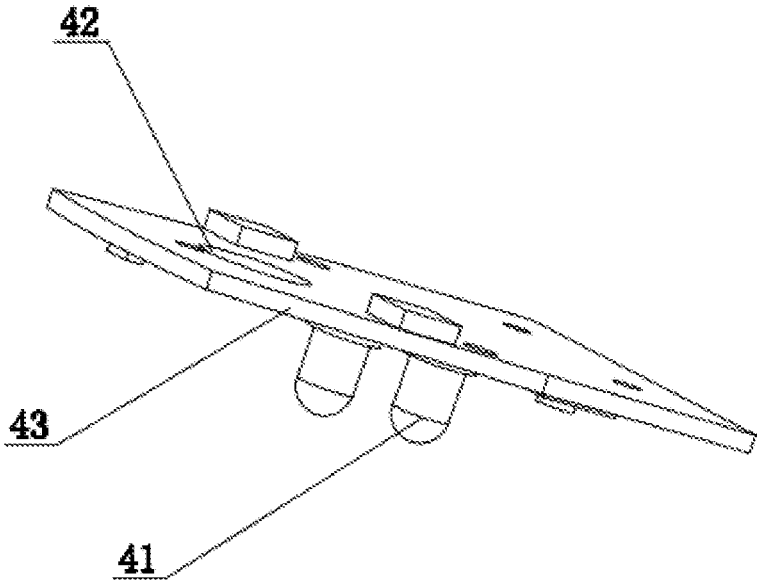
FIG. 5 is a schematic structural diagram of the electronic circuit board of this utility model.
Figure 6:
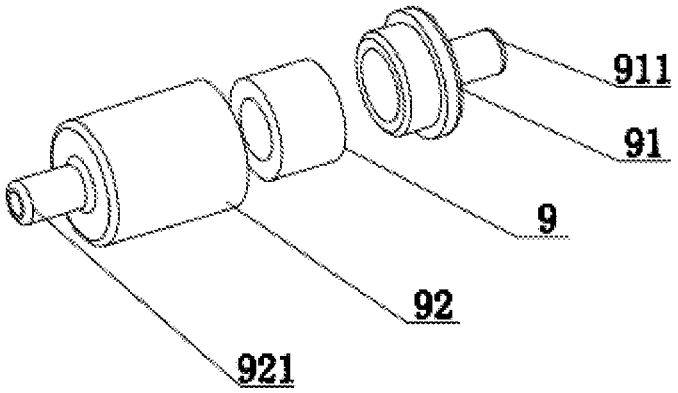
FIG. 6 is an exploded schematic diagram of the structure of the foam generator of this utility model.

Referring to FIGS. 1 to 6, the technical solution adopted in this specific embodiment is as follows: It includes a bottle cap body 1, a lower motor shell 2, a motor 3, an electronic circuit board 4, an upper motor shell 5, a cylindrical lithium battery 6, a motor battery cover 7, the lower end of the said bottle cap body 1 is provided with the lower motor shell 2, the upper end of the said lower motor shell 2 is provided with the upper motor shell 5, the said lower motor shell 2 is provided with the electronic circuit board 4, the motor 3 is arranged between the said lower motor shell 2 and the upper motor shell 5, and the lower motor shell 2 and the upper motor shell 5 are fixedly connected by a clip or fastening screws, the said upper motor shell 5 is provided with a control box 51, the said control box 51 has a rectangular structure, one end of the said control box 51 is provided with a counterbore groove 52, the said counterbore groove 52 is provided with a first battery compartment door lock 53 and a second battery compartment door fixing hole 54, the said first battery compartment door lock 53 and the second battery compartment door fixing hole 54 abut each other, the left and right sides of the said control box 51 and the first battery compartment door lock 53 are provided with fixing holes 55, there are a total of four fixing holes 55, the position where the outer periphery of the said control box 51 abuts against the upper motor shell 5 is provided with a battery compartment sealing rubber ring 8, the outer periphery of the said battery compartment sealing rubber ring 8 is provided with fixing posts 81, there are a total of four fixing posts 81, the said fixing posts 81 are provided in the fixing holes 55, the said control box 51 is provided with a cylindrical lithium battery 6, the upper end of the said cylindrical lithium battery 6 is provided with a battery compartment door 61, the said battery compartment door 61 is fixedly connected to the control box 51 through a clip, the upper end of the said battery compartment door 61 is provided with a motor battery cover 7, the said motor battery cover 7 is fixedly connected to the upper motor shell 5 through a clip, the said electronic circuit board 4 is provided with an infrared sensor 41 and a liquid outlet through hole 42, and the infrared sensor 41 can effectively quantify the amount of liquid for consistent dispensing, and avoid excessive or insufficient liquid dispensing by manual pressing. The upper end of the said electronic circuit board 4 is provided with an infrared transparent mirror 43, the said infrared transparent mirror 43 is provided with an infrared lamp cap 431, a button cap 432, a sealing ring 433 and a liquid outlet 434, the said infrared lamp cap 431 and the button cap 432 are arranged inside the infrared transparent mirror 43, the said sealing ring 433 is arranged on the outer periphery of the infrared transparent mirror 43, a liquid outlet 434 is provided on one end face of the said infrared transparent mirror 43, the said liquid outlet 434 is arranged in the liquid outlet through hole 42, and the said infrared transparent mirror 43 is arranged between the upper motor shell 5 and the electronic circuit board 4 through a sealing pad 44.

Further, the said bottle cap body 1 is cylindrical, the front end of the bottle cap body 1 is provided with a liquid dispensing part 56, and the said liquid dispensing part 56 is in the shape of a pointed cone extending integrally, and the front end of the said liquid dispensing part 56 is provided with an indicator light mirror 561.

Further, a foam generator 9 is provided on the side of the said motor 3. The design of the foam generator 9 can effectively change the liquid in the bottle body into liquid foam, so as to achieve the desired cleaning effect with the least amount of the cleaning liquid. One end of the said foam generator 9 is provided with a foam generator upper cover 91, and the other end is provided with a foam generator lower cover 92, the said foam generator upper cover 91 is provided with a first liquid passage 911, the said foam generator lower cover 92 is provided with a second liquid passage 921, the said second liquid passage 921 is connected to the liquid outlet 434, the said first liquid passage 911 is connected with a liquid suction tube 93, and the liquid suction end of the said liquid suction tube 93 passes through the lower motor shell 2 and is connected to the liquid in the liquid bottle body. During use, the electronic circuit board 4 on the infrared sensor 41 transmits the signal to the motor 3 to make it operate. At this time, the liquid suction end of the liquid suction tube 93 starts to suck liquid from the liquid bottle, then the sucked liquid flows through the foam generator 9 to generate liquid foam, and the liquid foam flows through the first liquid passage 911 of the foam generator 9 to the liquid outlet 434 and gets to the user's hand to complete the automatic liquid dispensing process.

Further, a replaceable bottle cap 21 is provided at the lower end of the said lower motor shell 2, the lower part of the said lower motor shell 2 and the inner part of the replaceable bottle cap 21 are provided with engaging threads, the said lower motor shell 2 and the replaceable bottle cap 21 are rotatably fixed by the engaging threads, the said replaceable bottle cap 21 can be flexibly replaced and used according to the size of the bottle body and cap actually used, the outer circumference of the said replaceable bottle cap 21 is provided with a first anti-skid pattern 211 distributed at equal intervals, the said first anti-skid pattern 211 facilitates the rotation of the replaceable bottle cap 21 to increase friction, the said replaceable bottle cap 21 is provided with a cap lock 22 and a concealed air inlet 23, the replaceable bottle cap 21 can be tightly connected with the liquid bottle mouth through the bottle cap lock 22, an outlet protection pad 24 is provided between the bottle cap lock 22 and the liquid bottle body, and the outlet protection pad 24 can provide effective waterproof and leak-proof protection, and facilitate the circulation of air inside and outside the bottle, thereby ensuring smooth liquid dispensing.

Further, the said motor 3, the electronic circuit board 4 and the control box 51 are electrically connected.

Further, there are two cylindrical lithium batteries 6, with the size of AAA, which provide power for the motor 3 and the electronic circuit board 4.

Further, the said motor battery cover 7 is provided with a second anti-skid pattern 71. The second anti-skid pattern 71 can increase the friction between the fingertip and the motor battery cover 7, so as to facilitate the removal of the motor battery cover 7.

Further, the said replaceable bottle cap 21 can be removed and installed on liquid bottles of different sizes at any time, so it has wide applicability.

The working principle of this utility model is as follows: Through the replaceable bottle cap, install the bottle cap body on an existing bottle body or special bottle body or general bottle body, or use it to replace the existing bottle cap directly, and fix it with the bottle cap lock during installation. The outlet protection pad is used for waterproof and leak-proof protection, and the liquid suction end of the liquid suction tube in the bottle cap body extends into the liquid bottle (containing hand sanitizer, shower gel, shampoo, cleanser, gel, etc.). During actual use, stretch your hand to the area below the liquid outlet, then the infrared sensor on the side of the liquid outlet can recognize and sense your hand, and the electronic circuit board transmits the signal to the motor to make it operate. At this time, the liquid suction end of the liquid suction tube starts to suck liquid from the liquid bottle, then the sucked liquid flows through the foam generator to generate liquid foam, and the liquid foam flows through the first liquid passage of the foam generator to the liquid outlet and gets to the user's hand to complete the automatic liquid dispensing process. When the liquid in the liquid bottle is used up, you can directly purchase the same kind of bagged liquid and pour it in the liquid bottle, and there is no need to replace the bottle body, which greatly reduces the user's use cost.

After adopting the above technical solution, the beneficial effects of this utility model are as follows: Through the setting of the infrared sensor, it can be widely used for liquid products such as shower gel, shampoo and hand sanitizer provided in medical institutions or public places. Compared with the traditional manual pressing head, it can effectively quantify the amount of liquid for consistent dispensing, and avoid excessive or insufficient liquid dispensing by manual pressing each time, and the bottle cap of this utility model can be removed and installed on liquid bottles of different sizes for use, or a general bottle body can be made for use with it. It is easy to operate, clean and hygienic, and does not require contact, with excellent use effect, effectively avoiding cross-infection and the spread of bacteria; meanwhile, its structural design is environmentally friendly, without the need to produce a certain number of bottles, and it can be reused after liquid is injected into the bottle. Its overall practicability is strong, and it has a great market promotion value.

The above description is only used to illustrate the technical solution of this utility model and not to limit it. Other modifications or equivalent substitutions made by those of ordinary skill in the art to the technical solution of this utility model should be covered in the scope of the claims of this utility model, as long as they do not depart from the spirit and scope of the technical solution of this utility model.

I claim:

1. An automatic liquid dispensing bottle cap with infrared induction and intelligent recognition, characterized in that it includes a bottle cap body (1), a lower motor shell (2), a motor (3), an electronic circuit board (4), an upper motor shell (5), a cylindrical lithium battery (6), a motor battery cover (7), the lower end of the said bottle cap body (1) is provided with the lower motor shell (2), the upper end of the said lower motor shell (2) is provided with the upper motor shell (5), the said lower motor shell (2) is provided with the electronic circuit board (4), the motor (3) is arranged between the said lower motor shell (2) and the upper motor shell (5), and the lower motor shell (2) and the upper motor shell (5) are fixedly connected by a clip, the said upper motor shell (5) is provided with a control box (51), the said control box (51) has a rectangular structure, one end of the said control box (51) is provided with a counterbore groove (52), the said counterbore groove (52) is provided with a first battery compartment door lock (53) and a second battery compartment door fixing hole (54), the said first battery compartment door lock (53) and the second battery compartment door fixing hole (54) abut each other, the left and right sides of the said control box (51) and the first battery compartment door lock (53) are provided with fixing holes (55), there are a total of four fixing holes (55), the position where the outer periphery of the said control box (51) abuts against the upper motor shell (5) is provided with a battery compartment sealing rubber ring (8), the outer periphery of the said battery compartment sealing rubber ring (8) is provided with fixing posts (81), there are a total of four fixing posts (81), the said fixing posts (81) are provided in the fixing holes (55), the said control box (51) is provided with a cylindrical lithium battery (6), the upper end of the said cylindrical lithium battery (6) is provided with a battery compartment door (61), the said battery compartment door (61) is fixedly connected to the control box (51) through a clip, the upper end of the said battery compartment door (61) is provided with a motor battery cover (7), the said motor battery cover (7) is fixedly connected to the upper motor shell (5) through a clip, the said electronic circuit board (4) is provided with an infrared sensor (41) and a liquid outlet through hole (42), the upper end of the said electronic circuit board (4) is provided with an infrared transparent mirror (43), the said infrared transparent mirror (43) is provided with an infrared lamp cap (431), a button cap (432), a sealing ring (433) and a liquid outlet (434), the said infrared lamp cap (431) and the button cap (432) are arranged inside the infrared transparent mirror (43), the said sealing ring (433) is arranged on the outer periphery of the infrared transparent mirror (43), a liquid outlet (434) is provided on one end face of the said infrared transparent mirror (43), the said liquid outlet (434) is arranged in the liquid outlet through hole (42), and the said infrared transparent mirror (43) is arranged between the upper motor shell (5) and the electronic circuit board (4) through a sealing pad (44).

2. The automatic liquid dispensing bottle cap with infrared induction and intelligent recognition according to claim 1, characterized in that the said bottle cap body (1) is cylindrical, the front end of the bottle cap body (1) is provided with a liquid dispensing part (56), and the said liquid dispensing part (56) is in the shape of a pointed cone extending integrally, and the front end of the said liquid dispensing part (56) is provided with an indicator light mirror (561).

3. The automatic liquid dispensing bottle cap with infrared induction and intelligent recognition according to claim 1, characterized in that a foam generator (9) is provided on the side of the said motor (3), one end of the said foam generator (9) is provided with a foam generator upper cover (91), and the other end is provided with a foam generator lower cover (92), the said foam generator upper cover (91) is provided with a first liquid passage (911), the said foam generator lower cover (92) is provided with a second liquid passage (921), the said second liquid passage (921) is connected to the liquid outlet (434), the said first liquid passage (911) is connected with a liquid suction tube (93, and the liquid suction end of the said liquid suction tube (93) passes through the lower motor shell (2) and is connected to the liquid in the liquid bottle body.

4. The automatic liquid dispensing bottle cap with infrared induction and intelligent recognition according to claim 1, characterized in that a replaceable bottle cap (21) is provided at the lower end of the said lower motor shell (2), the lower part of the said lower motor shell (2) and the inner part of the replaceable bottle cap (21) are provided with engaging threads, the said lower motor shell (2) and the replaceable bottle cap (21) are rotatably fixed by the engaging threads, the outer circumference of the said replaceable bottle cap (21) is provided with a first anti-skid pattern (211) distributed at equal intervals, the said replaceable bottle cap (21) is provided with a cap lock (22) and a concealed air inlet (23), and an outlet protection pad (24) is provided between the bottle cap lock (22) and the liquid bottle body.

5. The automatic liquid dispensing bottle cap with infrared induction and intelligent recognition according to claim 1, characterized in that the said motor (3), the electronic circuit board (4) and the control box (51) are electrically connected.

6. The automatic liquid dispensing bottle cap with infrared induction and intelligent recognition according to claim 1, characterized in that there are two cylindrical lithium batteries (6), with the size of AAA.

7. The automatic liquid dispensing bottle cap with infrared induction and intelligent recognition according to claim 1, characterized in that the said motor battery cover (7) is provided with a second anti-skid pattern (71).

* * * * *